United States Patent [19]

Vos et al.

[11] Patent Number: 4,994,212

[45] Date of Patent: Feb. 19, 1991

[54] PROCESS FOR MANUFACTURING A GAS GENERATING MATERIAL

[75] Inventors: Thomas H. Vos, Rochester; James M. Kumkoski, Utica, both of Mich.; Leo S. Knowlden, Gilbert, Ariz.; George W. Goetz, Rochester Hills, Mich.

[73] Assignee: TRW Vehicle Safety Systems Inc., Lyndhurst, Ohio

[21] Appl. No.: 528,144

[22] Filed: May 24, 1990

[51] Int. Cl.[5] ..... C06B 21/00

[52] U.S. Cl. ..... 264/3.3; 264/3.4; 264/3.5; 149/35; 149/109.6

[58] Field of Search ..... 149/35, 109.6; 264/3.1, 264/3.3, 3.4

[56] References Cited

U.S. PATENT DOCUMENTS

| | | | |
|---|---|---|---|
| 3,920,575 | 11/1975 | Shiki et al. | 252/188.3 |
| 3,996,079 | 12/1976 | DiValentin | 149/35 |
| 4,021,275 | 5/1977 | Kishi et al. | 149/35 |
| 4,243,443 | 1/1981 | Utracki | 149/35 |
| 4,758,287 | 7/1988 | Pietz | 149/2 |
| 4,817,828 | 4/1989 | Goetz | 222/3 |

OTHER PUBLICATIONS

Article entitled Air Bag Industry Retains Sodium Azide Despite Fires, Apr. 9, 1990 issue of Automotive Electronics Journal.

*Primary Examiner*—Peter A. Nelson
*Assistant Examiner*—Chrisman D. Carroll
*Attorney, Agent, or Firm*—Tarolli, Sundheim & Covell

[57] ABSTRACT

A process for manufacturing a gas generating material includes preparing a wet mixture of a metal azide and a metal oxide without prior mixing of the metal azide and metal oxide in dry form. The metal azide content of the gas generating material is controlled and the possibility of forming hazardous hydrazoic acid fumes is minimized by maintaining the temperature of the wet mixture of gas generating material between 20° C. and 30° C. The possibility of forming hydrazoic acid fumes is further reduced by maintaining the pH of the wet mixture of gas generating materials at or above 10.5. Excess liquid is removed from the wet mixture of gas generating materials so that the wet mixture has a moisture content of approximately 9%. The excess liquid from the wet mixture is recycled and used the formation of additional gas generating material. The wet mixture of gas generating materials, having a moisture content of approximately 9%, is formed through small openings to form extrudate of gas generating material.

43 Claims, 5 Drawing Sheets

PROCESS FOR MANUFACTURING A GAS GENERATING MATERIAL

BACKGROUND OF THE INVENTION

1. Technical Field

The present invention relates to a method for manufacturing gas generating material, and in particular relates to a method for manufacturing a gas generating material which contains an azide and a metal oxide and is used for generating gas to inflate a vehicle occupant restraint, such as an airbag.

2. Description of the Prior Art

U.S. Pat. No. 3,996,079 discloses a process for manufacturing an azide-containing gas generating composition. The dry ingredients of the gas generating composition are mixed together. A liquid is then added to the dry mixture to produce a plastic mass. Suitable liquids are water and ethanol. The liquid is about 15% by weight of the total composition and dissolves the finer particles of the azide ingredient. The plastic mass is then forced through a die, perforated plate, or sieve to form wet granules. The wet granules are then dried.

U.S. Pat. No. 4,758,287 also discloses a process for manufacturing an azide containing gas generating material. In this process a water slurry of gas generating material is prepared. The slurry is then molded into a desired shape and flash dried.

The known methods of making gas generating material which contains an azide and a metal oxide have not been entirely satisfactory because of a number of factors. In some known processes, the materials are mixed in dry form, which creates a safety hazard. Also, special precautions must be taken to guard against production of hazardous byproducts which can affect persons who come into contact with the by-products. Finally, the known processes do not provide for conserving materials.

SUMMARY OF THE INVENTION

The present invention relates to a process for manufacturing a gas generating material. The gas generating material is formed by preparing a wet mixture of preferably a metal azide and a metal oxide. The wet mixture of the metal azide and metal oxide is prepared without prior mixing of the metal azide and metal oxide in dry form. By having the metal azide and metal oxide contact each other only when they are wet, the possibility of fire and/or explosion is minimized during the manufacturing process.

During the manufacturing process, the formation of hazardous hydrazoic acid fumes ($HN_3$) is minimized by: (1) maintaining the wet mixture of a metal azide and metal oxide at a temperature not exceeding 30° C. and (2) maintaining the pH of the wet mixture of the metal azide and metal oxide at a value which is at least about 10.5. More specifically, the temperature of the wet mixture of gas generating material is sensed during the processing of the mixture and the temperature of the mixture is maintained within a desired range not exceeding 30° C. In addition, the pH of the wet mixture of gas generating material is sensed during the processing of the mixture and a base is added to the mixture to maintain the mixture at a pH of at least 10.5.

During processing of the wet mixture of gas generating material, the mixture is repeatedly ground to reduce the particle size of one or more ingredients of the mixture. During the grinding of the wet mixture, the mixture is also cooled to maintain the temperature of the mixture in a desired temperature range of 20° C. to 30° C.

Once the wet mixture of gas generating material has been formed, excess liquid is removed from the mixture. The liquid removed from the mixture is recycled by using the liquid to prepare additional wet mixture of the gas generating material. Once the excess liquid has been removed and the wet mixture has the desired moisture content, the wet mixture of gas generating material is forced through small openings to form extrudate of gas generating material.

The metal azide content of the extrudate of gas generating material is partially controlled by preparing and processing the wet mixture of gas generating materials at a temperature of 20° C. to 30° C. and preferably 25° C.±2° C. The solubility of the metal azide in the liquid phase of the wet mixture of gas generating material varies as a direct function of temperature. Therefore, for example, if the temperature of the wet mixture is too high, too much metal azide will be dissolved in the liquid. Thus, when the excess liquid is removed, too much azide will be removed from the gas generating material. Thus, the gas generating material will be "azide poor". Similarly, if the temperature of the wet mixture is too low, too little metal azide will be dissolved in the liquid. Therefore, when the excess liquid is removed too little azide will be removed from the gas generating material. Thus, the gas generating material will be "azide rich".

BRIEF DESCRIPTION OF THE DRAWINGS

The foregoing and other features of the present invention will become more apparent to one skilled in the art upon consideration of the following description in connection with the accompanying drawings, wherein.

DESCRIPTION OF A PREFERRED EMBODIMENT OF THE INVENTION

Body of Gas Generating Material

Figure 2:
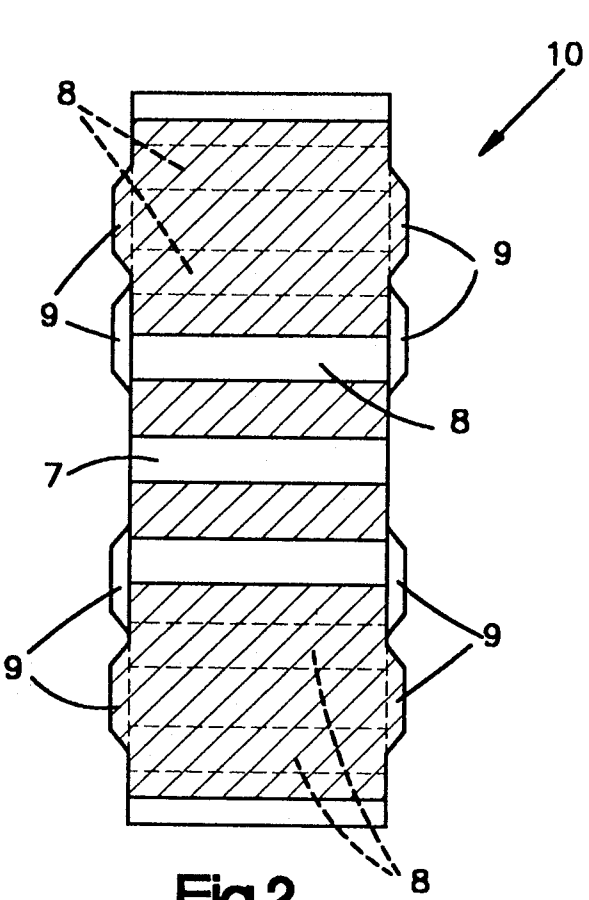
FIG. 2 is a sectional view, taken along the line 2—2 of FIG. 1, further illustrating the construction of the body of gas generating material.

A body 10 (known as a "grain") of gas generating material is used in inflatable vehicle occupant restraint systems to inflate an occupant restraint, such as an airbag. The body 10, or a plurality of bodies 10, of gas generating material could be used in many different types of inflatable restraint systems. One inflatable restraint system in which the bodies of gas generating material may be used is described in U.S. Pat. No. 4,817,828, assigned to the assignee of the present application, issued Apr. 4, 1989 and entitled "Inflatable Restraint System".

The body 10 of ga generating material includes a fuel which is a source of nitrogen gas and an oxidizer which reacts with the fuel. The body 10 of gas generating material also contains an oxidizing agent, extruding aid and strengthening fibers. The preferred fuel or source of nitrogen gas is an alkali metal azide, such as sodium, potassium or lithium azide. Sodium azide is the most preferred alkali metal azide. The oxidizer is preferably a metal oxide. The metal of the metal oxide may be any metal lower in the electromotive series than the alkali metal. Examples of preferred metals are iron, copper, manganese, tin, titanium, or nickel, and combinations thereof. The most preferred oxidizer is iron oxide.

The oxidizing agent in the body 10 may be an alkali metal nitrate, chlorate, and/or perchlorate or combinations of the foregoing. At the present time, it is preferred to use sodium nitrate as the oxidizing agent. Relatively small amounts of an extrusion aid and strengthening fibers are provided in the body 10 of gas generating material. Bentonite is the preferred extrusion aid. Graphite fibers are preferably used as the strengthening fibers.

The body 10 of gas generating material has the following proportions of ingredients by weight:

| Ingredient | Amount | Range |
|---|---|---|
| Sodium azide ($NaN_3$) | 57.9% | ±10% |
| Iron oxide ($Fe_2O_3$) | 34.6% | ±10% |
| Graphite | 3% | 0 to 6% |
| Bentonite | 2.5% | 0 to 5% |
| Sodium Nitrate ($NaNO_3$) | 2% | 0 to 10% |

It should be understood that the composition of the body 10 of gas generating material could be different than the specific composition set forth above. For example, an alkali metal azide other than sodium azide could be used. Also, a different oxidizer could be used. Although graphite fibers are preferred to provide mechanical reinforcement, other fibers could be used, such as glass fibers and iron fibers. Extrusion aids other than bentonite could be used and/or oxidizing agents other than sodium nitrate could be used, such as ammonium perchlorate. If desired, the composition of the body of gas generating material could be the same as described in U.S. Pat. No. 4,806,180, assigned to the assignee of the present application, issued Feb. 21, 1989 for "Gas Generating Material".

The body 10 has a generally cylindrical shape and has a cylindrical central passage 7 with an axis disposed on the central axis of the grain. The passage 7 extends between axially opposite end faces of the body. In addition, the body 10 has a plurality of cylindrical passages 8 which are disposed radially outwardly relative to central passage 7 and which also extend longitudinally through the body between the opposite end faces.

Figure 1:
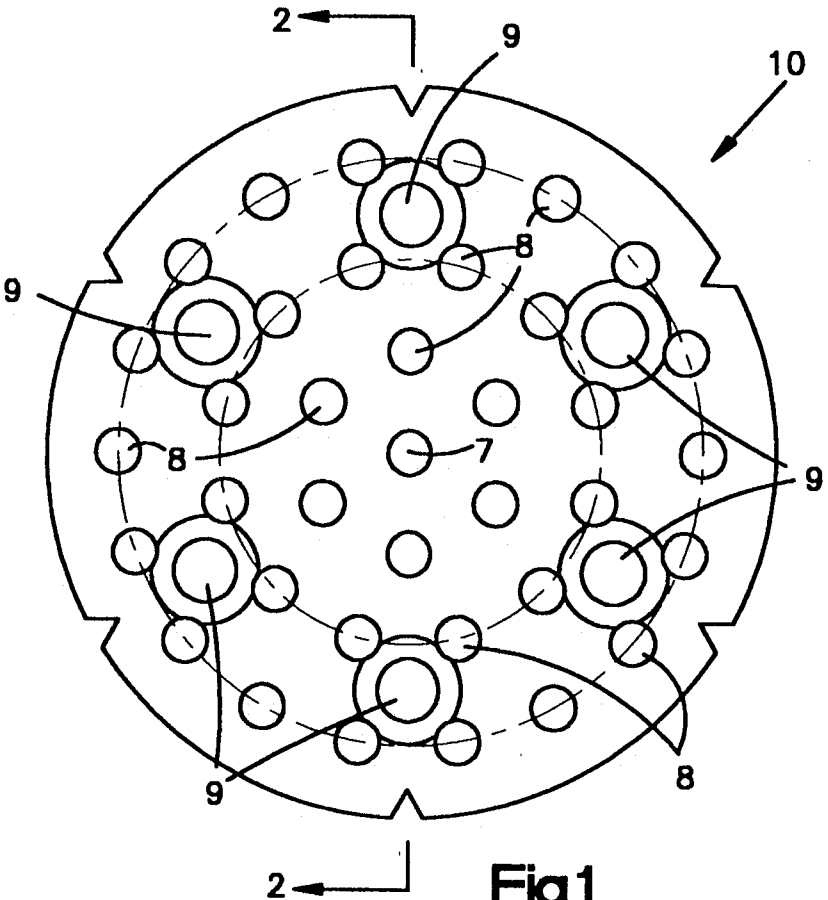
FIG. 1 is a plan view of a body of gas generating material used in a vehicle occupant restraint system.

The axes of the passages 8 are parallel to the axis of passage 7. The passages 8 are evenly spaced, on concentric circles which are radially spaced from passage 7, but co-axial with the axis of passage 7. As shown in FIG. 1, the axes of the passages 8 on one of the concentric circles are offset circumferentially, to one side, from the axes of the passages 8 on the other concentric circles. In this respect, a passage 8 on a first concentric circle is spaced from an offset passage on an adjacent concentric circle the same distance that it is spaced from an adjacent passage 8 on the first concentric circle.

When used to inflate an airbag, the plurality of bodies 10 are stacked so that the passages in one body are aligned with the passages in all of the other bodies. Thus, hot gas generated by burning one body flows through the passages to ignite adjacent bodies, and the surfaces of the passages of all of the bodies are quickly ignited.

The gas which is generated within the passages must be able to get out of the passages and flow radially of the bodies into an airbag to inflate the airbag. To provide for such flow, spaces are provided between the end faces of adjacent bodies 10. The spaces extend radially outward from the central passage 7 of the bodies. The spaces between the ends of adjacent bodies are provided by axially projecting standoff pads 9 on the end faces. As disclosed in prior U.S. Pat. No. 4,817,828, the standoff pads of one body are aligned with those of an adjacent body so that the spaces between the bodies are provided by the standoff pads of adjacent bodies. Several standoff pads 9 are positioned in circumferentially spaced apart relationship on each end face so as to maintain the end faces of adjacent bodies in spaced apart parallel planes.

The plurality of passages 7, 8 in a body 10 promote what has been referred to as a progressive rate of burn of a body. A progressive rate of burn is on in which the burning proceeds, for a substantial part of the burn cycle, at a rate which increases. As the circumferential surfaces of the passages burn, the passages widen, exposing increasingly more surface area to burning. Simultaneously, the outer circumference of each body 10 shrinks, reducing the surface area exposed to burning, but this reduction in surface area is less than the increase in surface area produced by burning in the passages in the body. At a point in the burn cycle, the burn rate ceases to increase and remains constant until near the end of the burn cycle, at which time the rate of burn will decrease to zero.

Process of Manufacture—General Description

Figure 3:
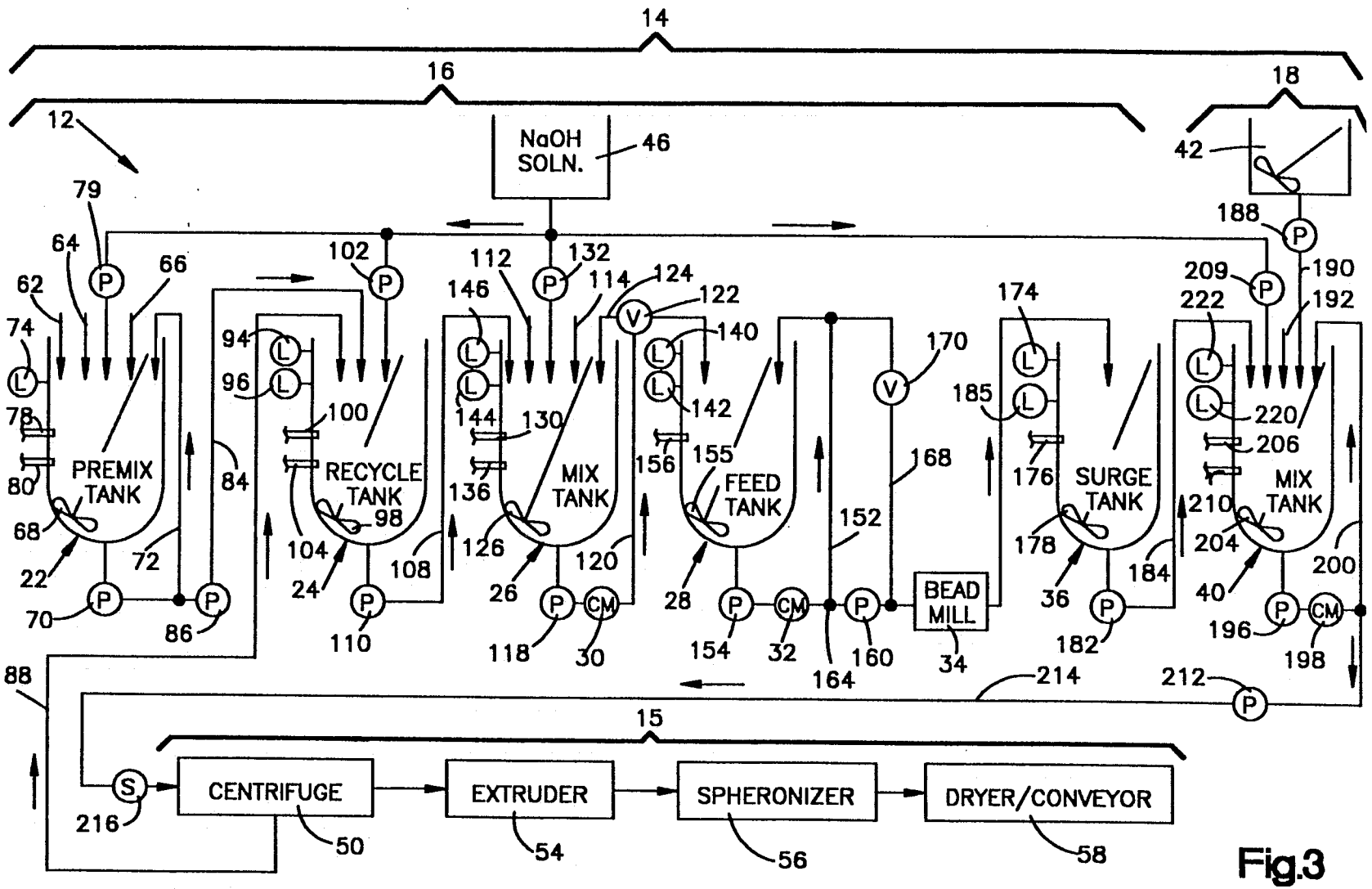
FIG. 3 is a schematic illustration depicting process equipment used in a process of manufacturing gas generating material for forming the body of gas generating material illustrated in FIGS. 1 and 2.

The gas generating material used in the body 10 is manufactured in a process using the apparatus 12 illustrated schematically in FIG. 3. The apparatus 12 includes a first stage of process equipment 14 which is used to prepare a wet mixture of the gas generating material and a second stage of process equipment 15 which is used to process the wet mixture of gas generating material. The first stage of process equipment for preparing a wet mixture of gas generating material includes preliminary process equipment 16 for use in preparing a first or initial wet mixture of gas generating material and secondary process equipment 18 for use in preparing a second or final wet mixture of the gas generating material.

The preliminary process equipment 16 is used to prepare an aqueous based initial wet mixture of sodium azide ($NaN_3$), iron oxide ($Fe_2O_3$) and sodium nitrate ($NaNO_3$). This is done without mixing the sodium azide and iron oxide in dry form. Avoiding the mixing of the sodium azide and iron oxide when dry reduces the possibility of explosion and/or fire during the preparation of the gas generating material.

The preliminary process equipment 16, which is used to prepare the first or initial wet mixture of gas generating material, includes a premix tank 22 where sodium azide and sodium nitrate are mixed with fresh water to form a saturated solution. The saturated solution in the premix tank 22 is conducted from the premix tank to a recycle tank 24. In the recycle tank 24, recycled liquid from a previous wet mixture of gas generating material is added to the saturated solution from the premix tank. The recycled liquid has the same ingredients in the same proportions as the saturated solution in the premix tank 22. However, the recycled liquid may contain trace amounts of ingredients no found in the saturated solution in the premix tank 22. The recycling of liquid formed in making a wet mixture of gas generating material conserves material and eliminates the necessity of additional processing to dispose of liquid as waste.

From the recycle tank 24, the saturated solution is conducted to a main mix tank 26. In the main mix tank 26, sodium azide powder and iron oxide powder are added to the wet mixture without prior mixing of the sodium azide and iron oxide powders in dry form. By avoiding dry mixing of the sodium azide and iron oxide powders, the possibility of fire or explosion is minimized.

The wet mixture is then conducted from the main mix tank 26 to a feed tank 28. In the feed tank 28, the various ingredients of the initial wet mixture of gas generating material are further mixed to form a homogeneous mixture.

The initial wet mixture is repeatedly ground to obtain a desired particle size. Thus, the wet mixture in the main mix tank 26 is repeatedly circulated through a colloid mill 30 in a manner to be described. Similarly, the wet mixture in the feed tank 28 is repeatedly circulated through a second colloid mill 32 in a manner to be described. The wet mixture from the feed tank 28 is then conducted through a bead mill 34. The output from the bead mill 34 is conducted to a surge tank 36.

The secondary process equipment 18 for preparing a second or final wet mixture includes a second main mix tank 40 which receives the initial wet mixture of gas generating material from the surge tank 36. Graphite slurry from a graphite slurry tank 42 is added to the initial wet mixture in the second main mix tank 40. In addition, bentonite powder is added to the first or initial mixture in the second main mix tank 40. The addition of the graphite slurry and bentonite to the wet mixture in the tank 40 completes the preparation of the wet mixture of gas generating material.

From the second main mix tank 40, the second or final wet mixture of gas generating material is conducted to the second stage process equipment 15. The process equipment 15 includes a centrifuge 50 where liquid is removed from the wet mixture of gas generating material. The liquid removed from the wet mixture of gas generating material is conducted back to the recycle tank 24 and reused. By reusing the liquid removed from the wet mixture of gas generating material, the disposal of the liquid as waste is avoided.

The wet mixture of gas generating material from the centrifuge 50 is conducted to an extruder 54. The extruder 54 forms the wet mixture of gas generating material into generally cylindrical extrudate. This is done by forcing the wet mixture of gas generating material through small openings.

The cylindrical extrudate of gas generating material are formed into a spherical shape by a spheronizer 56. The spherical granules of gas generating material ar then conducted to a conveyor drier 58 in which they are dried as they move through the dryer to a moisture content of 1% to 5% by weight. The spherical granules are subsequently molded, in a known manner, to form the bodies 10 (FIGS. 1 and 2) of gas generating material.

In order to provide the bodies 10 (FIG. 1) of gas generating material with the desired burning characteristics, the bodies of gas generating material must contain predetermined amounts of sodium azide. If the liquid (filtrate) removed from the wet mixture of gas generating material in the centrifuge 50 contains too little or too much sodium azide, the wet mixture (cake) remaining in the centrifuge will contain too much or too little sodium azide. Therefore, the sodium azide content of the liquid removed from the wet mixture in the centrifuge must be controlled.

The solubility of sodium azide in water varies as a direct function of temperature. Therefore, the amount of sodium azide in the liquid removed from the wet mixture by the centrifuge 50 will vary with temperature. Thus, the temperature of the wet mixture of gas generating material is controlled. The temperature of the wet mixture of gas generating material in the centrifuge is maintained within the temperature range of 20° C. to 30° C. and is preferably at 25° C.±2° C.

Preparation of Wet Mixture

The first stage 14 of the process equipment is used to prepare a wet mixture of a metal azide and metal oxide without prior mixing of the metal azide and metal oxide in a dry form. In the process, a metered flow of fresh water, represented by the arrow 62 in FIG. 3, is conducted into the premix tank 22. When a metered flow of water is to be conducted into the premix tank 22, a valve (not shown) is opened and a predetermined amount of water is released into the tank.

A predetermined amount of sodium azide powder, represented by the arrow 64 in FIG. 3, is also conducted to the premix tank 22. A weigh feeder is used to weigh and feed the predetermined amount of sodium azide. Sodium nitrate is also added to the premix tank 22, as represented by an arrow 66 in FIG. 3. The amount of sodium nitrate added to the tank 22 is also measured with a weigh feeder. The premix tank 22 preferably contains 62.9% water, 26.3% sodium azide, which is in solution, and 10.8% sodium nitrate, which is also in solution. The premix tank 22 thus contains a saturated solution of sodium azide and sodium nitrate.

The saturated solution in the tank 22 is mixed by a mixer 68. The tank 22 is provided with a rounded or arcuate bottom to promote the formation of a homogeneous saturated solution in the tank 22. The saturated solution in the tank 22 is recirculated by a pump 70 which pumps the saturated solution from the bottom of the tank through a conduit 72 back into the tank. The premix tank 22 is refilled when a level sensor 74 detects that the level of the mixture in the tank 22 is below a predetermined level. It is contemplated that the volume of the tank 22 will be such that it can supply the requirements of the rest of the process equipment for approximately twenty-four hours before the tank 22 must be refilled.

It is contemplated that the tank 22, and tanks 24, 26, 28, 36 and 40 and/or conduits for the tanks, will periodically be flushed. The liquids used for flushing the tanks and/or conduits will contain sodium azide and other ingredients used in the process. The liquid from flushing the tanks may be added to the premix tank 22. If this is to be done, the liquid is first analyzed to determine its contents. The liquid may then be modified to have the same ingredients in the same portions as the material in the premix tank 22. Alternatively, the flushing liquid may be added to the premix tank 22, and the contents of the tank 22 analyzed and ingredients added to the tank so that the composition of the mixture in the tank 22 is not effected by the addition of the flushing liquid. By using the flushing liquid, materials are conserved and the disposal of the liquid as waste is avoided.

There is a tendency for hydrazoic acid ($HN_3$) to form in the premix tank 22. Hydrazoic acid fumes are explosive and toxic and should be avoided. Also, the formation of hydrazoic acid consumes sodium azide, thereby affecting the amount of sodium azide in the solution in the tank. To prevent the formation of hydrazoic acid in the premix tank 22, the pH of the liquid in the premix tank is maintained at or above 10.5 and preferably at 11 or above. The pH of the saturated solution in the premix tank 22 is sensed by a probe 78.

To maintain the pH of the saturated solution in the premix tank 22 at 10.5 or more, a base is added to the saturated solution in the premix tank 22. Thus, whenever, the probe 78 senses that the pH of the saturated solution in the premix tank 22 is approaching 10.5, a metering pump 79 is operated. Operation of the metering pump 79 conducts a metered flow of sodium hydroxide from a sodium hydroxide tank 46 to the premix tank 22. When the probe 78 senses that the pH of the saturated solution in the premix tank 22 has increased to or slightly above 11, the flow of sodium hydroxide into the premix tank is stopped.

The temperature of the saturated solution in the premix tank 22 is maintained between 20° C. and 30° C. and preferably at 25° C.±2° C. Maintaining the temperature of the saturated solution in the premix tank 22 between 20° C. and 30° C. further minimizes the possibility of the formation of hydrazoic acid fumes. This is because hydrazoic acid boils at 35° C. In addition, maintaining the wet mixture in the premix tank in this temperature range controls the amount of sodium azide dissolved into the water in the premix tank 22. Thus, the desired amount of sodium azide is maintained in solution in the premix tank 22, and therefore a desired materials balance is maintained in the premix tank.

A temperature sensor or probe 80 extends into the premix tank 22 to sense the temperature of the wet mixture in the tank. The environment around the tank and around all of the process equipment with the possible exception of the drier 58 is maintained within the temperature range of 20° C. to 30° C. and preferably at 25° C.±2° C. In addition, the relative humidity of the surrounding environment is maintained at approximately 40%.

An endothermic reaction occurs between water and sodium nitrate. Due to the endothermic reaction between the sodium nitrate ($NaNO_3$) which is added to the premix tank 22 and the water in the tank, the wet mixture in the premix tank 22 tends to cool. Therefore, the premix tank 22 is heated to maintain the wet mixture in the tank between 20° C. and 30° C. and usually at 25° C.±2° C. This is accomplished by conducting a relatively warm liquid around the outside of the premix tank 22.

The saturated solution in the premix tank 22 is pumped into the recycle tank 24 through a conduit 84 by a pump 86. In addition, liquid removed from a previous wet mixture of gas generating material by the centrifuge 50 is directed into the recycle tank 24 through a conduit 88. Since the liquid from the previous wet mixture has the same ingredients in solution in the same percentages by weight as the solution in the premix tank 22, the percentage by weight of the ingredients in the recycle tank 24 is the same as the percentages by weight of the ingredients in the premix tank 22. Trace amounts of solids may also be removed from the previous wet mixture and are directed into the recycle tank.

A control valve (not shown) for the conduit 84 is closed and the pump 86 is stopped when an upper liquid level sensor 94 detects that the level of liquid in the recycle tank has reached a predetermined maximum level. When a lower liquid level sensor 96 detects that the level of the liquid in the recycle tank 24 has been reduced to the desired minimum level, the valve is reopened and the pump 86 is started to raise the level of the liquid in the recycle tank 24. A mixer 98 is provided in the round bottom recycle tank 24 to promote the formation of a homogeneous solution in the recycle tank.

In order to avoid the formation of hydrazoic acid in the recycle tank 24, the pH of the saturated solution in the recycle tank 24 is maintained at or above 10.5 and preferably at 11. When a pH sensor probe 100 detects that the pH level of the saturated solution in the recycle tank 24 is approaching 10.5, a metering pump 102 is actuated to meter a flow of sodium hydroxide (NaOH) to the recycle tank 24 from the sodium hydroxide tank 46. A relatively small amount of sodium hydroxide is required to maintain the pH of the saturated solution in the recycle tank 24 at a pH of at least 10.5.

The temperature of the saturated solution in the recycle tank 24 is maintained between 20° C. and 30° C., and preferably at a temperature of 25° C.±2° C. A temperature sensor 104 senses the temperature of the saturated solution in the recycle tank 24.

The saturated solution from the recycle tank 24 is pumped to the main mix tank 26 through a conduit 108 by a metering pump 110. Cooling of the metering pump 110 is controlled by sensor 104. In the main mix tank 26, a predetermined amount of sodium azide ($NaN_3$) powder, represented by the arrow 112 in FIG. 3, is added to the saturated solution from the recycle tank 24. The amount of sodium azide powder added in the main mix tank 26 is measured by a weigh feeder.

In addition, iron oxide ($Fe_2O_3$) powder, represented by the arrow 114 in FIG. 3, is added in the main mix tank 26. The amount of iron oxide added to the main mix tank 26 is also measured by a weigh feeder. The metering pump 110 and the weigh feeders for the sodium azide and iron oxide are controlled by maximum and minimum liquid level sensors 146, 144, respectively. The main mix tank 26 preferably contains 51.5% by weight of solution from the recycle tank, 19.1% by weight of iron oxide, and 29.4% by weight of sodium azide. Thus, the wet mixture in the main mix tank 26 is preferably 48.5% solids. However, the wet mixture in the main mix tank 26 may be between 45% and 55% solids to facilitate grinding of the wet mixture.

In order to minimize any possibility of fire and/or explosion, the sodium azide and iron oxide powders are conducted into the main mix tank 26 without premixing in a dry form. Thus, the sodium azide powder and iron oxide powder are placed separately into the main mix tank 26. The sodium azide and iron oxide powders do not come into contact with each other until after the powders have been wetted by the liquid in the main mix tank 26.

The wet mixture from the main mix tank 26 is recirculated by a screw-type pump 118 through the colloid mill 30, conduit 120 and solenoid valve 122. Initially, the solenoid valve 122 is actuated to a condition in which the wet mixture is returned to main mix tank 26 through a conduit 124.

The wet mixture from the main mix tank 26 is recirculated by the pump 118 through the colloid mill 30 for at least twenty minutes before being conducted from the main mix tank 26 to the feed tank 28. By recirculating the wet mixture and mixing the mixture in the tank with the mixer 126, a homogeneous mixture is obtained. The wet mixture in the main mix tank makes a minimum of six passes through the colloid mill 30 to grind the sodium azide particles in the wet mixture. Although iron oxide particles of a different size could be used, the iron oxide particles are advantageously supplied in a size such that they do not have to be reduced in size by the colloid mill 30.

To prevent the formation of hydrazoic acid ($HN_3$), the pH of the wet mixture in the main mix tank 26 is maintained at or above 10.5 and preferably at 11. A pH sensor 130 senses the pH of the wet mixture in the main mix tank 26. When the pH sensor 130 detects that the pH of the wet mixture in the main mix tank is approaching 10.5, a metering pump 132 is operated to meter a flow of sodium hydroxide solution from the secondary tank 46 into the wet mixture in the main mix tank 26.

To further minimize the possibility of the formation of hydrazoic acid fumes and to control the amount of sodium azide in solution, the wet mixture in the main mix tank 26 is maintained between 20° C. and 30° C. and preferably at 25° C.±2° C. A temperature sensor 136 senses the temperature in the main mix tank 26. The wet mixture is cooled in the colloid mill 30. A temperature sensor (not shown) is provided after the colloid mill 30 to sense the temperature of the mixture and along with temperature sensor 136 controls the flow of coolant through the colloid mill.

After the wet mixture in the main mix tank 26 has been recirculated through the colloid mill 30 for at least twenty minutes, the solenoid valve 122 is actuated to direct a flow of the wet mixture from the conduit 120 into the feed tank 28. The valve 122 stays actuated, that is directing the flow of the wet mixture into the feed tank 28, until an upper liquid level sensor 140 detects that a maximum level has been obtained in the feed tank 28. When a liquid level sensor 142 detects a minimum level in the tank 28, the solenoid valve 122 is again actuated to circulate the wet mixture to the feed tank 28.

The wet mixture in the feed tank 28 is recirculated through the colloid mill 32 and conduit 152 by a pump 154. A mixer 155 in the round bottom feed tank 28 further promotes the maintenance of a homogeneous mixture in the feed tank.

The temperature of the wet mixture in the feed tank 28 is maintained in a temperature range between 20° C. and 30° C. and preferably at a temperature of 25° C.±2° C. A temperature sensor 156 senses the temperature of the wet mixture in the feed tank 28. The colloid mill 32 is cooled to maintain the temperature of the wet mixture in the colloid mill between 20° C. and 30° C. and preferably at a temperature of 25° C.±2° C. A temperature sensor (not shown) is provided after the colloid mill 32 to sense the temperature of the mixture and along with the sensor 156 controls the flow of coolant through the colloid mill.

During recirculation of the wet mixture by the pump 154, a screw-type pump 160 maintains a continuous flow of the wet mixture to the bead mill 34. Thus, at a T connection 164, the flow of the wet mixture from the colloid mill 32 is divided with the majority of the flow going back to the feed tank 28 through the conduit 152. However, a portion of the flow of the wet mixture from the colloid mill 32 is conducted from the open T connection 164 to the pump 160 and bead mill 34. In the specific embodiment of the apparatus illustrated in FIG. 3, the T connection 164 is sized to split the flow of the wet mixture from the feed tank 28 in a fourteen to one ratio. Thus, fourteen times as much of the wet mixture is conducted through the recirculating conduit 152 as is conducted to the pump 160 through the T connection 164.

If the bead mill 34 should, for some unforeseen reason, become plugged or otherwise fail, the wet mixture is conducted through a conduit 168 to a combination pressure relief and check valve 170. When the fluid pressure in the conduit 168 exceeds a predetermined maximum pressure, the valve 170 opens and there is a flow of the wet mixture through the conduit 168 back to the feed tank 28.

The bead mill 34 continuously grinds a flow of the wet mixture from the pump 160. The wet mixture is cooled in the bead mill 34 to maintain the wet mixture within a temperature range of between 20° C. and 30° C., and preferably at a temperature of 25° C.±2° C. A temperature sensor (not shown) is provided after the bead mill 34 to sense the temperature of the mixture and control the flow of coolant through the bead mill. The colloid mills 30 and 32 and bead mill 34 are effective to grind the sodium azide from a particle diameter of approximately 180 microns to a particle diameter of approximately 1 to 5 microns.

The wet mixture continuously flows from the bead mill 34 into the surge tank 36. However, if an upper liquid level sensor 174 at the surge tank 36 detects that the liquid level in the surge tank has reached a predetermined maximum, the operation of the pump 160 and bead mill 34 is interrupted to prevent the surge tank 36 from overflowing. It is contemplated that during normal operation of the bead mill 34, it will not be necessary to interrupt operation of the bead mill.

To retard the formation of hydrazoic acid fumes and to control the amount of sodium azide in solution, the temperature of the wet mixture in the surge tank 36 is maintained between 20° C. and 30° C. and preferably at 25° C.±2° C. A temperature sensor 176 senses the temperature of the wet mixture in the surge tank 36. A mixer 178 is provided in the surge tank 36 to maintain a homogeneous mixture in the surge tank.

A metering pump 182 pumps the initial wet mixture from the surge tank 36 through a conduit 184 to the second main mix tank 40. Cooling of the metering pump 182 is controlled by sensor 176. A lower level sensor 185 detects that the level of the mixture in the surge tank 36 is at a predetermined level, and starts operation of the pump 182 when the level of material in the tank 36 is sufficient to deliver a batch of material to the second main mix tank 40. In the second main mix tank 40, measured quantities of graphite and bentonite are mixed with the wet mixture from the surge tank 36. Thus, a graphite slurry is conducted from the graphite mixing tank 42 through a metering pump 188 and a conduit 190 to the second main mix tank 40. The graphite slurry is 15% by weight graphite and 85% by weight solution.

The solution has the same ingredients in the same proportions as the solution in the premix tank 22. The solution is 62.9% by weight water, 26.3% by weight sodium azide and 10.8% by weight sodium nitrate.

In addition, bentonite powder is added to the wet mixture in the second main mix tank 40 through a conduit indicated schematically at 192 in FIG. 3. The amount of bentonite powder added to the wet mixture in the second main mixing tank is measured by a weigh feeder. The second main mix tank 40 preferably contains 54.2% by weight saturated solution; 1.2% by weight bentonite; 1.5% by weight graphite; 17.0% by weight iron oxide; and 26.1% by weight sodium azide.

The wet mixture in the second main mix tank 40 is recirculated by a pump 196 through a colloid mill 198 and conduit 200 to the second main mix tank 40 at a relatively high rate. The wet mixture in the second main mix tank 40 is recirculated for a sufficient time period, on the order of one hour, to insure that a homogeneous mixture is obtained. The colloid mill 198 functions to agglomerate the material instead of grinding the material. This occurs because the material as it flows through the colloid mill 198 is mixed together and tends to stick together. In addition, a mixing element 204 is operable to stir the mixture in the second main mix tank 40.

To retard the formation of hydrazoic acid ($HN_3$), the pH of the wet mixture in the second main mix tank 40 is maintained at or above 10.5 and preferably at 11. A pH sensor 206 is provided to sense the pH of the wet mixture in the main mix tank 40. If the pH of the wet mixture in the main mix tank 40 is approaching 10.5, a metering pump 209 is operated to pump sodium hydroxide solution from the tank 46 into the second main mix tank 40.

The total amount of the sodium hydroxide base added to the wet mixture in the premix tank 22, recycle tank 24, main mix tank 26 and second main mix tank 40 is relatively small. Thus, the total amount of sodium hydroxide added to the wet mixture is less than 0.5% of the weight of sodium azide in the wet mixture in the second main mixing tank 40. This amount of sodium hydroxide is so small it is ignored in parts of this application and treated as non-existent in the final product and in the recycled material. It should be understood that known bases other than sodium hydroxide could be used to control the pH of the wet mixtures of gas generating materials.

The temperature of the wet mixture in the second main mix tank 40 and colloid mill 198 is maintained between 20° C. and 30° C. and preferably at 25° C.±2° C. A temperature sensor 210 senses the temperature of the wet mixture in the second main mix tank. A temperature sensor (not shown) is also provided after the colloid mill 198 to sense the temperature of the mixture and along with sensor 210 controls the flow of coolant through the colloid mill.

A metering pump 212 pumps a metered flow of the wet mixture from the second main mix tank 40 through a conduit 214 to a mass flow sensor 216. The wet mixture flows through the mass flow sensor 216 into the centrifuge 50. When a lower liquid level sensor 220 detects that the level of the liquid in the second main mix tank 40 is sufficient to deliver a batch to the centrifuge 50, the pump 212 is started. An upper liquid level sensor 222 indicates that the level of the wet mixture in the tank 40 is excessive and stops pump 182 to avoid overflowing.

The centrifuge 50 is operable to remove excess liquid from the wet mixture received from the second main mix tank 40. When the wet mixture leaves the centrifuge 50, it has a moisture content between about 7% and about 11% and is preferably about 9%. The wet mixture is conducted to an extruder 54 which forces the wet mixture through small openings to form small cylindrical extrudate. The extrudate are formed into spheres by a spheronizer 56. These spherical granules are then dried to a moisture content of 1% to 5% by weight and used in the formation of the bodies 10 (FIGS. 1 and 2) of gas generating material.

If the moisture content of the wet mixture from the centrifuge is too high, the material after extrusion will stick together. If the moisture content is too low, the extruder will jam. A suitable moisture probe (not shown) senses the moisture in the material from the centrifuge. If the moisture content is too low, the centrifuge is controlled to reduce its time of operation and thus remove less moisture. If the moisture content is too high, the centrifuge is operated for a longer time period. The centrifuge acts on a batch of wet mixture for about ten to eleven minutes to provide the wet mixture with a desired moisture content of 7% to 11% and preferably 9%.

The bodies 10 of gas generating material must contain predetermined amounts of sodium azide in order to produce the desired amount of nitrogen gas when the bodies 10 are burned. If the liquid removed from the wet mixture of gas generating material by the centrifuge 50 contains too much dissolved sodium azide, the bodies 10 of gas generating material will contain less than the desired predetermined amount of sodium azide. If the liquid removed from the wet mixture of gas generating material by the centrifuge 50 contains too little dissolved sodium azide, the bodies 10 of gas generating material will contain more than the desired predetermined amount of sodium azide.

Also, the amount of sodium azide which can be dissolved in a given amount of water increases as the temperature of the water increases. Therefore, the wet mixture of gas generating material is maintained throughout the process as close as possible to 25° C.±2° C. and at least 20° C. to 30° C. As a result, the liquid removed by the centrifuge 50 does not contain too much or too little azide, which would result in the remaining mixture having too little (azide poor) or too much (azide rich) azide.

Apparatus

The centrifuge 50 is located at a liquid removal station and reduces the moisture content of the wet mixture of gas generating materials to between about 7% and about 11% and preferably about 9%. Different centrifuges may be used. Preferably, the centrifuge contains a known inverting filter for assisting in discharging the filter cake from the centrifuge.

Figure 4:
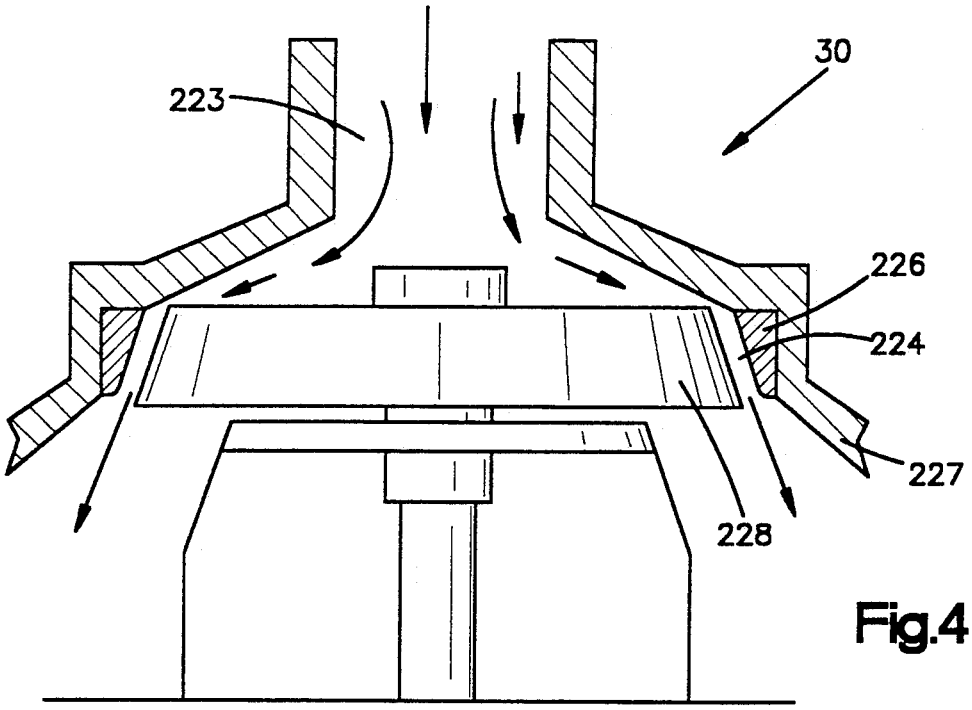
FIG. 4 is a schematic illustration of a colloid mill used in the apparatus of FIG. 3.

The colloid mill 30 is schematically illustrated in FIG. 4. The colloid mill 30 has an inlet 223 through which the wet mixture from the main mix tank 26 enters the colloid mill. The wet mixture from the main mix tank passes through a narrow grinding gap 224 between annular inner side surface of a stator 226 and an annular outer side surface of a rotor 228. The grinding gap between the rotor and stator is adjustable between 0.001 and 0.125 of an inch. The specific grinding gap provided in the colloid mill 30 will depend upon the size of the particles used in forming the wet mixture of gas generating material. As the wet mixture from the main mix tank 26 passes through the gap 224, the particles in the wet mixture are ground.

Although the construction of only the colloid mill 30 has been illustrated in FIG. 4, it should be understood that the colloid mills 32 and 198 have the same construction as the colloid mill 30. The colloid mills 30, 32 and 198 are cooled by a flow of cooling liquid through jackets (not shown) around the stator 226 and the spillway 227 along which the wet mixture of gas generating material is conducted from the grinding gap.

Figure 5:
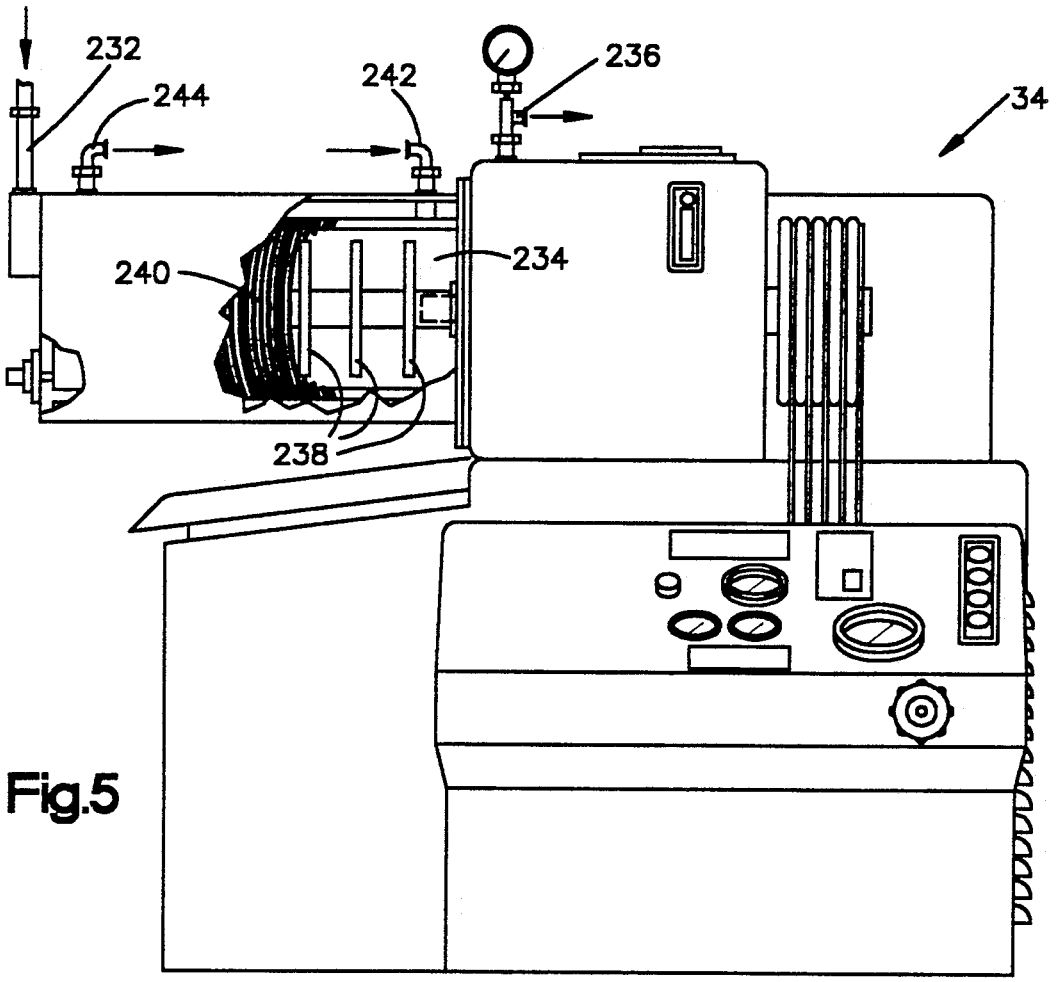
FIG. 5 is a partially broken away schematic illustration of a bead mill used in the apparatus of FIG. 3.

The construction of the bead mill 34 is illustrated in FIG. 5. The bead mill 34 has an inlet 232 through which the wet mixture from the feed tank 28 is pumped by the metering pump 160 (FIG. 3). There is a continuous flow of the wet mixture through a cylindrical grinding chamber 234 to an outlet 236.

The grinding chamber 234 is 80% full of spherical zirconia beads having a diameter of approximately one millimeter. A plurality of circular, open-centered, disks 238 rotate at a speed of 1,150 to 1,600 rpm in the grinding chamber 234 to agitate the zirconia beads. This results in the wet mixture of gas generating material being subjected to intense impact and high shear loads created by the zirconia beads. The grinding chamber 234 of the bead mill 34 is enclosed by a spiral cooling coil 240. Liquid coolant is conducted from an inlet 242 through the cooling coil 240 to an outlet 244 to cool the wet mixture in the grinding chamber 234.

When the wet mixture of gas generating material is moving through the grinding chamber 234, the wet mixture is between 45% and 55% solids by weight and preferably 48.5% solids. If the amount of solids is less than 45%, it has been found that the zirconia elements in the bead mill 34 tend to grind themselves, while if the wet mixture contains more than 55% solids, the bead mill 34 tends to plug.

Figure 6:
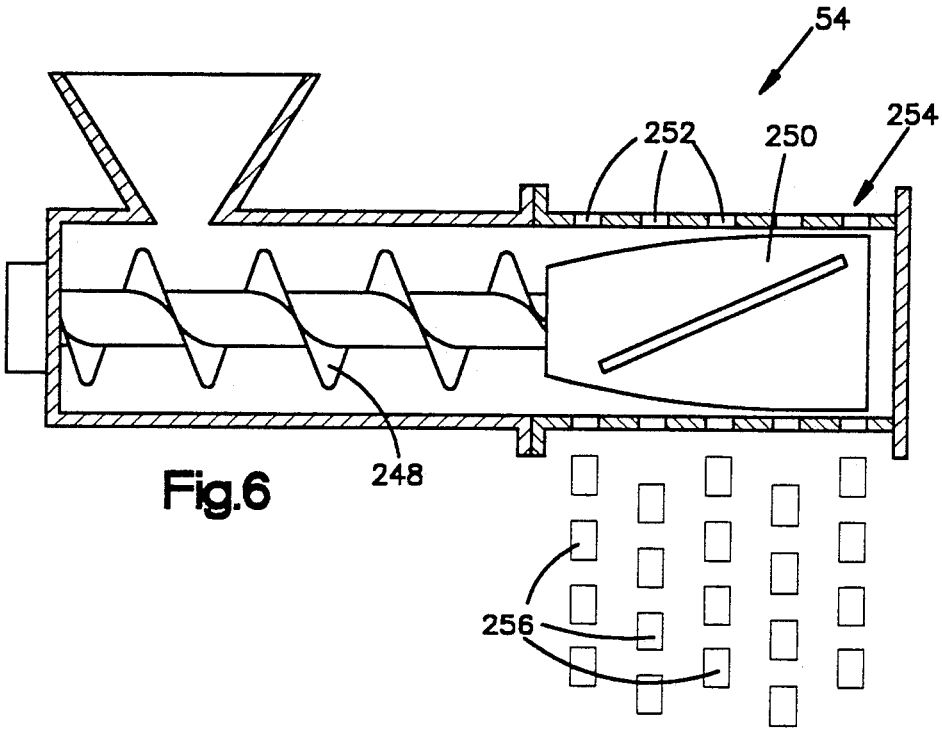
FIG. 6 is a schematic illustration of an extruder used in the apparatus of FIG. 3.

The extruder 54 (FIG. 6) is of the screw-type and has a feed screw 248 which feeds the wet mixture of gas generating material to an extruder head 250. The extruder head 250 forces the wet mixture of gas generating material through small openings 252 formed in a cylindrical die plate 254. The wet mixture of gas generating material, having a moisture content of approximately 9%, is forced through the openings 252 and is formed into cylindrical extrudate 256. Preferably, the extruder 54 is a twin screw type extruder. Each of the screws has a coolant flowing through a cooling passage in the screw.

Figure 7:
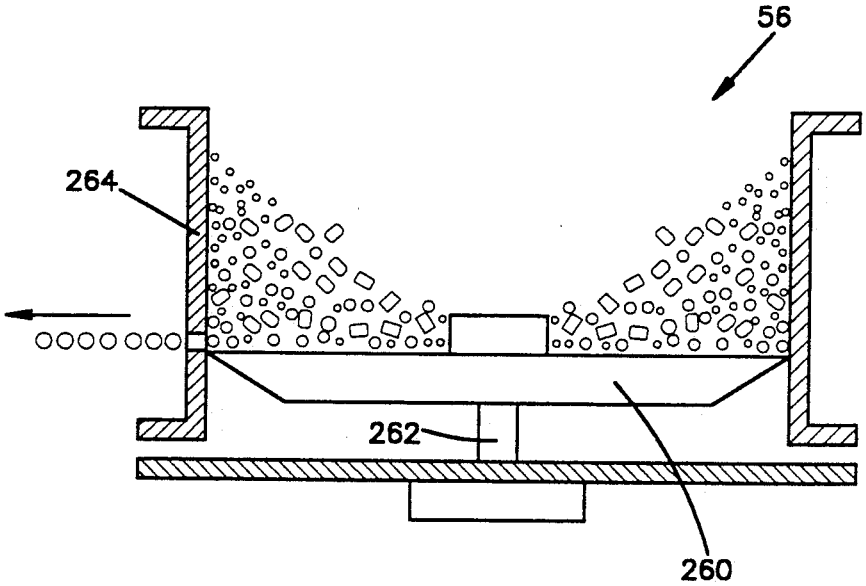
FIG. 7 is a schematic illustration of a spheronizer used in the apparatus of FIG. 3.

The construction of the spheronizer 56 is known and is illustrated schematically in FIG. 7. The spheronizer 56 has a circular disk 260 which is rotated by a drive shaft 262. The upper surface of the disk 260 is formed with two sets of grooves which intersect at right angles.

The cylindrical extrudate 256 from the extruder 54 are placed on the disk 260 near its center. The high speed rotating disk 260 centrifugally urges the extrudate 256 radially outwardly on the disk. As this occurs, the extrudate 256 ar hurled against the inside wall of a cylindrical bowl 264. Centrifugal and gravitational forces create a mechanically fluidized ring of extrudate which rotate against the plate 260 and the wall 264. As each of the cylindrical extrudate rotates, its shape is gradually changed from cylindrical to spherical. The bowl 264 may be heated to prevent the material from sticking to the bowl by flowing a heated liquid through passages (not shown) in the wall of the bowl.

Process of Forming Bodies of Gas Generating Materials

Figure 8:
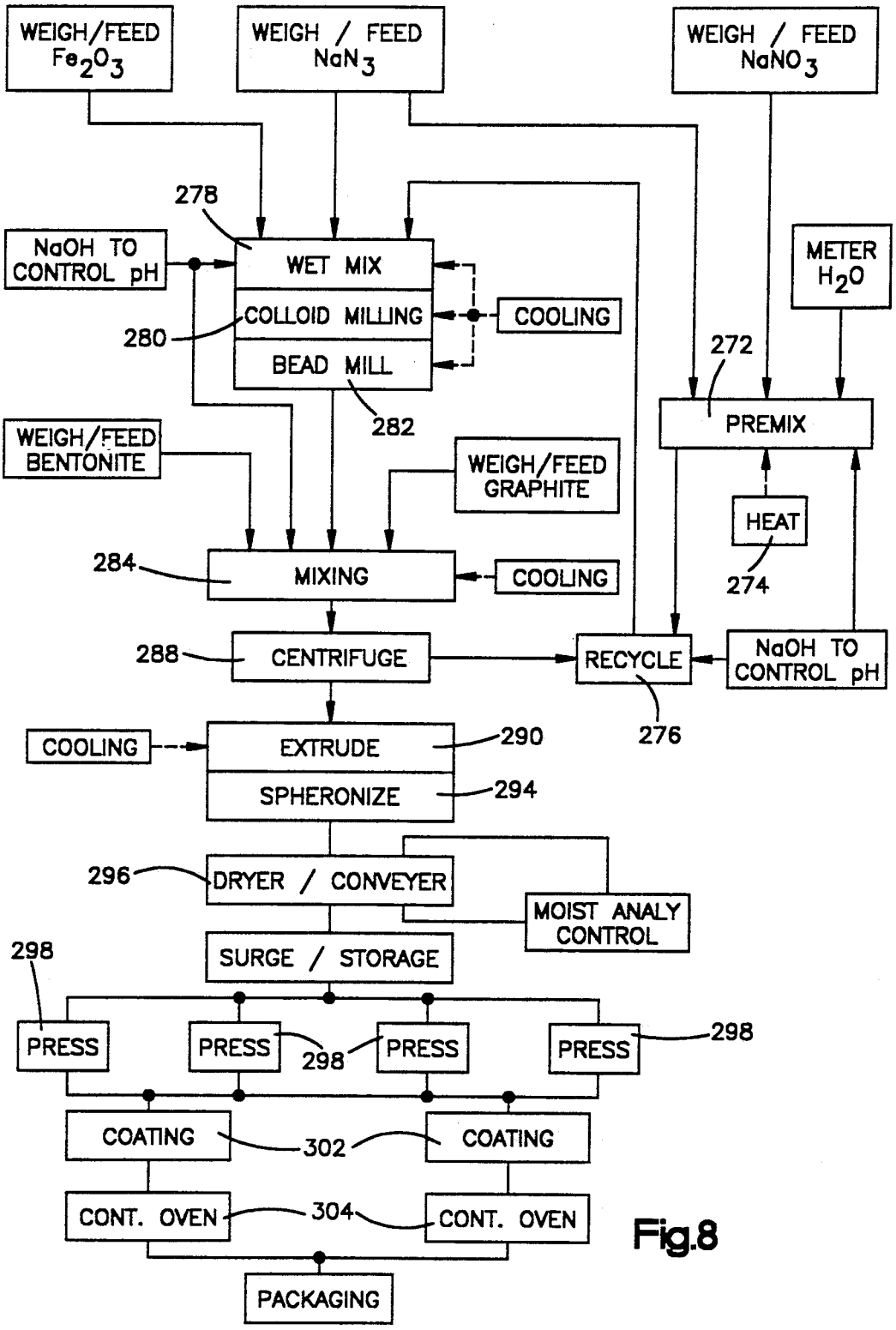
FIG. 8 is a flow diagram of the process used to manufacture gas generating material with the apparatus of FIG. 3.

The process by which the apparatus of FIGS. 3–7 is used to form the bodies 10 of gas generating material is illustrated by the flow chart of FIG. 8 and should be understood from the above description. In practicing the process, the step of premixing sodium azide ($NaN_3$), sodium nitrate ($NaNO_3$) and water ($H_2O$) is indicated at 272. The premixing of the sodium azide, sodium nitrate and water occurs in the premix tank 22 of FIG. 3. Due to the reaction of sodium nitrate with water, the solution in premix tank 22 is heated, as indicated at 274 in FIG. 8. The solution formed by the premix step 272 is mixed with liquid from the centrifuge 50 (FIG. 3) in a recycle step indicated schematically at 276 in FIG. 8.

The solution formed during the recycle step 276 is mixed with additional sodium azide and with iron oxide ($Fe_2O_3$) to form a wet mixture in a step indicated at 278 in FIG. 8. The iron oxide and additional sodium azide are mixed together without prior mixing of the iron oxide and sodium azide in dry form. Since the iron oxide and sodium azide are not intermixed in a dry condition, the possibility of fire and/or explosion is minimized.

The wet mixture of sodium azide, iron oxide and sodium nitrate is ground in colloid mills 30 and 32 during a first grinding step indicated at 280 in FIG. 8. The wet mixture is then ground in the bead mill 34 during a second grinding step indicated at 282 in FIG. 8. During the grinding steps 280 and 282, the wet mixture of gas generating material is cooled to maintain the mixture in the temperature range of 20° to 30° C. and preferably 25° C.±2° C.

After the initial wet mixture of gas generating material has been formed and the gas generating material has been repeatedly ground, additional ingredients are added to the mixture in a second main mixing step, indicated at 284 in FIG. 8, to form a second mixture. In the second mixing step 284, bentonite and graphite are added to the initial wet mixture of gas generating material. During the mixing of the bentonite and graphite with the initial mixture of gas generating material, the mixture is maintained at a temperature between 20° C. and 30° C. and preferably 25° C.±2° C.

During the premixing, recycle, and first and second main mixing steps 272, 276, 278 and 284 the pH of the gas generating material is continuously monitored and maintained at or above 10.5 and preferably at 11. This is accomplished by continuously sensing the pH of the gas generating material and adding sodium hydroxide (NaOH) to control the pH level. By maintaining the pH at or above 10.5, the formation of hydrazoic acid ($HN_3$) is avoided.

After the gas generating materials have been prepared and the mixing step 284 is completed, the gas generating materials are processed to form granules which are used to make the gas generating bodies 10 of FIGS. 1 and 2. To form the granules, it is first necessary to reduce the moisture content of the gas generating material to approximately 9%. This is accomplished by a centrifuging step indicated at 288 in FIG. 8. The liquid removed from the gas generating material during the centrifuging step 288 is reused during the recycle step 276.

The wet mixture (cake) of gas generating material from the centrifuging step 288 is extruded, as indicated schematically at 290 in FIG. 8, to form small cylindrical extrudate of the gas generating material. During the extrusion step 290 the gas generating material is cooled by coolant conducted through the extruder.

The extrudate from the extrusion step 290 are formed into spherical granules in a spheronizing step 294. The spherical granules are then subjected to a drying step 296 in which they are dried to a moisture content of 1% to 5% by weight. The granules may then be stored for later use. The spherical granules are removed from storage and pressed together, as indicated at 298 in FIG. 8, to form bodies of gas generating material having the same configuration as the bodies 10 of FIGS. 1 and 2. Although the pressing step 298 to form the bodies 10 of gas generating material has been indicated as being carried out in four different presses in FIG. 8, the bodies of gas generating material could be formed in any number of presses.

Once the bodies 10 of gas generating material have been formed by the pressing step 298, it is preferred to coat the bodies of gas generating material with an ignition enhancing material as indicated at 302 in FIG. 8. The coated bodies of gas generating material are then transferred to continuous ovens where they are dried in the step indicated at 304 in FIG. 8. The dried bodies 10 of gas generating material are then packaged for use in a vehicle occupant restraint system.

In the foregoing description, the flow of the various materials has been described in a manner which corresponds to manual actuation of the various control elements. However, it is contemplated that the process may be controlled, in whole or in part, by a computer.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, the following is claimed:

1. A process for manufacturing a gas generating material comprising the steps of:

preparing a wet mixture of a metal azide and a metal oxide without prior mixing of the metal azide and metal oxide in dry form;

processing the wet mixture to form granules of gas generating material;

drying the granules of gas generating material; and maintaining the mixture in a wet state throughout said processing prior to said step of drying the granules.

2. A process as set forth in claim 1 wherein said step of preparing a wet mixture of a metal azide and a metal oxide includes mixing a metal azide powder and a metal oxide powder in a liquid.

3. A process as set forth in claim 1 wherein said step of preparing a wet mixture of a metal azide and a metal oxide includes mixing a metal oxide powder in a liquid containing a metal azide.

4. A process as set forth in claim 1 wherein said step of processing said wet mixture to form granules of gas generating material includes removing liquid from the wet mixture, said step of preparing a wet mixture of a metal azide and a metal oxide including mixing the metal azide and the metal oxide with the liquid removed from the wet mixture.

5. A process as set forth in claim 4 wherein said step of mixing the metal azide and the metal oxide with the liquid removed from the wet mixture includes adding the metal azide to the wet mixture and, thereafter, adding the metal oxide to the liquid removed from the wet mixture.

6. A process as set forth in claim 1 further including the step of sensing the pH of the wet mixture of a metal azide and a metal oxide and increasing the base content of the wet mixture if the sensed pH is below a predetermined number.

7. A process as set forth in claim 1 further including the step of sensing the temperature of the wet mixture of a metal azide and a metal oxide and cooling the wet mixture if the temperature of the wet mixture exceeds a predetermined temperature.

8. A process as set forth in claim 1 further including the steps of maintaining the mixture at a pH of at least 10.5 and at a temperature of 20° C. to 30° C. during said step of processing the wet mixture.

9. A process as set forth in claim 1 wherein said step of processing the wet mixture includes repeatedly grinding the wet mixture and, thereafter, removing liquid from the wet mixture.

10. A process as set forth in claim 1 wherein said wet mixture comprises 45% to 55% by weight of solids.

11. A process for manufacturing a gas generating material comprising the steps of:

preparing a first wet mixture of ingredients of the gas generating material in a first supply tank;

grinding the first wet mixture at a grinding location spaced from the first supply tank;

thereafter, directing the first wet mixture into a second supply tank;

adding additional ingredients to the first wet mixture in the second supply tank and preparing a second wet mixture in the second supply tank;

directing the second wet mixture from the second supply tank to a liquid removal station;

removing liquid from the second wet mixture at the liquid removal station to provide the second mixture with a desired moisture content; and forming the second mixture with the desired moisture content into particles.

12. A process as set forth in claim 11 wherein said step of preparing a first wet mixture includes preparing a wet mixture of a metal azide and a metal oxide without prior mixing of the metal azide and metal oxide in dry form.

13. A process as set forth in claim 11 further including the steps of sensing the pH of the first wet mixture and adding a material to the first wet mixture to increase the pH of the first wet mixture in response to sensing that the first wet mixture has a pH below a predetermined number, sensing the pH of the second wet mixture and adding a material to the second wet mixture to increase the pH of the second wet mixture in response to sensing that the second wet mixture has a pH below a predetermined number.

14. A process as set forth in claim 11 further including the steps of cooling the first wet mixture during preparing and grinding of the first wet mixture.

15. A process as set forth in claim 11 wherein said step of removing liquid from the second wet mixture at the liquid removal station to provide the second mixture with a desired moisture content includes the step of reducing the moisture content of the second mixture to between 7% and 11% by weight.

16. A process as set forth in claim 11 further including the step of conducting liquid removed from the second wet mixture at the liquid removal station to the first supply tank to recycle the liquid.

17. A process as set forth in claim 11 wherein said step of forming said second mixture with the desired moisture content into particles includes forcing the second mixture through a plurality of openings.

18. A process as set forth in claim 11 further including the step of maintaining the first wet mixture at a temperature of 20° C. to 30° C. during said steps of preparing the first wet mixture and grinding the first wet mixture.

19. A process for manufacturing a gas generating material comprising the steps of:

preparing a wet mixture of a metal azide and an oxidizer without prior mixing of the metal azide and oxidizer in dry form;

processing the wet mixture to form granules of gas generating material;

drying the granules of gas generating materials after processing the mixture to form granules; and maintaining the mixture at a temperature of 20° C. to 30° C. during said preparing and processing steps.

20. A process as defined in claim 19 wherein said oxidizer comprises a metal oxide.

21. A process as set forth in claim 20 further including the step of maintaining the mixture at a pH of at least 10.5 during said step of processing the wet mixture.

22. A process as set forth in claim 20 wherein said step of processing the wet mixture includes removing liquid from the wet mixture, said process further including the step of using the liquid to form additional wet mixture.

23. A process as set forth in claim 20 wherein said step of preparing the wet mixture includes grinding a wet mixture of a metal azide and metal oxide and adding an extrusion aid and strengthening fibers t the mixture after performing said grinding step.

24. A process as set forth in claim 20 wherein said step of preparing a wet mixture of a metal azide and a metal oxide without prior mixing of the metal azide and metal oxide in dry form includes preparing a solution of the metal azide and an oxidizing agent in a first tank, said step of maintaining the mixture at a temperature of 20° C. to 30° C. during said preparing and processing steps including heating the solution in the first tank, said step of preparing a wet mixture of a metal azide and a metal oxide without prior mixing of the metal azide and metal oxide in dry form further includes directing the solution from the first tank to a second tank and adding metal oxide powder and metal azide powder to the solution in the second tank, said step of maintaining the mixture at a temperature of 20° C. to 30° C. during said preparing and processing steps further includes cooling the wet mixture in the second tank.

25. A process as set forth in claim 24 wherein said step of processing the wet mixture to form granules includes removing liquid from the wet mixture, said method further including recycling the removed liquid by mixing it with the solution of a metal azide and an oxidizing agent prior to performing said step of adding metal oxide powder and metal azide powder to the wet mixture in the second tank.

26. A process as set forth in claim 19 wherein said step of preparing a wet mixture of a metal azide and a metal oxide includes grinding the wet mixture of the metal azide and metal oxide, said step of maintaining the mixture at a temperature of 20° C. to 30° C. includes cooling the mixture while performing said grinding step, said step of processing the wet mixture to form granules includes extruding the wet mixture through a plurality of openings after performing said step of grinding the wet mixture, said step of maintaining the mixture at a temperature of 20° C. to 30° C. including cooling the mixture while performing said extruding step.

27. A process as set forth in claim 19 wherein said wet mixture comprises 45% to 55% by weight of solids.

28. A process for manufacturing a gas generating material comprising the steps of:

preparing a wet mixture of a metal azide and an oxidizer;

sensing the pH of the mixture;

adding a base material to the mixture to maintain the pH of the mixture greater than about 10.5; and processing the mixture to form particles of gas generating material.

29. A process as set forth in claim 28 wherein said oxidizer comprises a metal oxide.

30. A process as set forth in claim 29 wherein said step of adding a base material to the mixture to maintain the pH of the mixture greater than 10.5 includes adding a source of hydroxide ions to the mixture.

31. A process as set forth in claim 29 further including adding additional ingredients to the wet mixture, said step of sensing the pH of the mixture including sensing the pH of the mixture prior to adding the additional ingredients to the mixture and sensing the pH of the mixture after adding the additional ingredients to the mixture, said step of adding a base material to the mixture to maintain the pH of the mixture greater than about 10.5 including adding base material to the mixture before the additional ingredients are added to the mixture and after adding the additional ingredients to the mixture.

32. A process as set forth in claim 29 further including the step of maintaining the temperature of the mixture at a temperature of from 20° C. to 30° C. during said step of preparing a wet mixture.

33. A process as set forth in claim 29 wherein said step of preparing a wet mixture of a metal azide and a metal oxide includes preparing the wet mixture without prior mixing of the metal azide and metal oxide in dry form.

34. A process for manufacturing a gas generating material comprising the steps of:

preparing a wet mixture of a metal azide and an oxidizer;

processing the mixture to form particles of gas generating material including removing liquid from the mixture to provide the mixture with a desired moisture content; and recycling the removed liquid by utilizing the removed liquid during said step of preparing a wet mixture.

35. A process as set forth in claim 34 wherein said step of removing liquid from the mixture to provide the mixture with a desired moisture content includes reducing the moisture content of the mixture to approximately 9%.

36. A process as set forth in claim 34 wherein said step of recycling the removed liquid includes adding oxidizer to the removed liquid during performance of said step of preparing a wet mixture.

37. A process as set forth in claim 34 wherein said step of recycling the removed liquid includes adding an oxidizing agent to the removed liquid.

38. A process as set forth in claim 34 wherein said step of preparing a wet mixture of a metal azide and an oxidizer is performed without prior mixing of the metal azide and oxidizer in dry form.

39. A process as set forth in claim 34 wherein said step of processing the mixture comprises forcing the mixture through a plurality of openings after performing said step of removing liquid from the mixture.

40. A process as set forth in claim 34 wherein said step of preparing a wet mixture of a metal azide and an oxidizer includes repeatedly grinding the we mixture.

41. A process as set forth in claim 34 wherein said step of preparing a wet mixture of a metal azide and an oxidizer includes maintaining the temperature of the wet mixture at 20° C. to 30° C.

42. A process as set forth in claim 41 wherein said step of preparing a wet mixture of a metal azide and an oxidizer includes sensing the pH of the mixture and maintaining the pH of the mixture above 10.5.

43. A process as set forth in claim 34 wherein said wet mixture comprises 45% to 55% by weight of solids.

* * * * *

UNITED STATES PATENT AND TRADEMARK OFFICE

CERTIFICATE OF CORRECTION

PATENT NO. : 4,994,212

DATED : February 19, 1991

INVENTOR(S) : Thomas H. Vos, James M. Kumkoski, Leo S. Knowlden, and George W. Goetz

It is certified that error appears in the above-identified patent and that said Letters Patent is hereby corrected as shown below:

Column 17, Line 33, Claim 23, Change "t" to --to--.

Column 19, Line 7, Claim 40, Change "we" to --wet--.

Signed and Sealed this

Twenty-third Day of June, 1992

*Attest:*

DOUGLAS B. COMER

*Attesting Officer*

*Acting Commissioner of Patents and Trademarks*